US012228296B2

(12) United States Patent
Liu

(10) Patent No.: US 12,228,296 B2
(45) Date of Patent: Feb. 18, 2025

(54) OUTDOOR UNIT ELECTRIC CABINET AND AIR CONDITIONER WITH OUTDOOR UNIT ELECTRIC CABINET

(71) Applicant: Guangdong Giwee Technology Co. Ltd., Foshan (CN)

(72) Inventor: Xueshu Liu, Foshan (CN)

(73) Assignee: GUANGDONG GIWEE TECHNOLOGY CO. LTD., Foshan (CN)

( * ) Notice: Subject to any disclaimer, the term of this patent is extended or adjusted under 35 U.S.C. 154(b) by 409 days.

(21) Appl. No.: 17/532,241

(22) Filed: Nov. 22, 2021

(65) Prior Publication Data

US 2022/0163222 A1 May 26, 2022

(30) Foreign Application Priority Data

Nov. 23, 2020 (CN) ..... 202022732283.2

(51) Int. Cl.
*F24F 1/22* (2011.01)
*F24F 13/20* (2006.01)

(52) U.S. Cl.
CPC ..... *F24F 1/22* (2013.01); *F24F 13/20* (2013.01)

(58) Field of Classification Search
CPC ..... F24F 1/22; F24F 13/20; F24F 1/24; F24F 1/56
See application file for complete search history.

(56) References Cited

U.S. PATENT DOCUMENTS 8,047,013 B2 * 11/2011 Ishikawa ..... F24F 13/20 62/259.1
8,978,393 B2 * 3/2015 Hika ..... F24F 1/46 62/298
2009/0077988 A1 * 3/2009 Ishikawa ..... F24F 1/22 62/515
2012/0194041 A1 * 8/2012 Hika ..... F24F 1/46 312/100
2021/0025642 A1 * 1/2021 Hika ..... H01L 23/4006

FOREIGN PATENT DOCUMENTS

| | | | |
|---|---|---|---|
| EP | 2481993 | A1 | 8/2012 |
| JP | H07318110 | A | 12/1995 |
| KR | 20150091616 | A * | 8/2015 |
| WO | 2019049777 | A1 | 3/2019 |
| WO | 2019179203 | A1 | 9/2019 |

OTHER PUBLICATIONS

European Search Report for application EP21209485.8, dated Apr. 8, 2022, 7 pages.

* cited by examiner

*Primary Examiner* — Kimberley S Wright
(74) *Attorney, Agent, or Firm* — CANTOR COLBURN LLP

(57) ABSTRACT

An outdoor unit electric cabinet, includes a box body, two supporting frames, an upper mounting plate, and a fixing plate, the two supporting frames are arranged on inner walls on the opposite sides of the box body; a mounting location is arranged on each supporting frame; the opposite sides of the upper mounting plate are mounted into the mounting location from an entrance of the mounting location; the upper mounting plate is flippable relative to the mounting location; the fixing plate is mounted on the entrance of the mounting location to seal the entrance of the mounting location, so as to prevent the upper mounting plate from sliding out from the mounting location.

8 Claims, 5 Drawing Sheets

OUTDOOR UNIT ELECTRIC CABINET AND AIR CONDITIONER WITH OUTDOOR UNIT ELECTRIC CABINET

FOREIGN PRIORITY

This application claims priority to Chinese Patent Application No. 202022732283.2, filed Nov. 23, 2020, and all the benefits accruing therefrom under 35 U.S.C. § 119, the contents of which in its entirety are herein incorporated by reference.

TECHNICAL FIELD

This disclosure relates to the field of air conditioner technologies, especially to an outdoor unit electric cabinet and an air conditioner with the outdoor unit electric cabinet.

BACKGROUND

Air conditioner products are developing in the direction of compact structure and high energy efficiency. The compact structure of the electric cabinet is an important subject of the compact structure of the product. The miniaturization of the entire electric cabinet structure is of great significance for improving the energy efficiency of the product and reducing the cost. In order to achieve the miniaturization of the electric cabinet structure, the use of double-layer or multi-layer design is an effective means to make full use of space. However, the use of multilayer design will face difficulties in assembly and maintenance. Due to the obstruction of the upper structure, the installation and maintenance of lower parts are hindered.

SUMMARY

A main aim of this disclosure is to provide an outdoor unit electric cabinet and an air conditioner with the outdoor unit electric cabinet, which solves the technical problem that the structure of a multilayer electric cabinet is complicated and installation and maintenance of lower parts are hindered in the prior art.

This disclosure provides an outdoor unit electric cabinet, comprising a box body, two supporting frames, an upper mounting plate, and a fixing plate, wherein the two supporting frames are arranged on inner walls on the opposite sides of the box body; a mounting location is arranged on each supporting frame; the opposite sides of the upper mounting plate are mounted into the mounting location from an entrance of the mounting location; the upper mounting plate is flippable relative to the mounting location; the fixing plate is mounted on the entrance of the mounting location to seal the entrance of the mounting location, so as to prevent the upper mounting plate from sliding out from the mounting location.

Further, the supporting frame comprises a main body portion and a first flanging, the main body portion comprises a first straight plate and a second straight plate; the first straight plate and the second straight plate are fixedly connected to form an angle; the second straight plate is bent away from one side of the first straight plate to form the first flanging; the main body portion is connected to the box body by means of the first flanging; and the entrance of the mounting location is arranged on the second straight plate.

Further, the supporting frames are arranged on the bottom of inner walls on two sides of the box body; two sides of the upper mounting plate are bent to form the second flanging; a connecting plate is arranged on two ends of the bottom of the upper mounting plate; the connecting plate and the second flanging are arranged in a same direction; and a rotation shaft runs through the connecting plate and the second flanging; and fixing positions are arranged on two ends of the rotation shaft, and a portion between a fixing portion close to the second flanging on the rotation shaft and the second flanging is mounted on the mounting location.

Further, the mounting location is a U-shaped groove; the entrance of the mounting location is communicated with the U-shaped groove; and the longest straight line of a contact surface between the fixing portion close to the second flanging and the first straight plate is greater than the width of the U-shaped groove.

Further, the fixing plate is L-shaped; a longitudinal plate of the fixing plate is inserted into a gap between the first straight plate and the second flanging; and a first screw thread hole used to fix the fixing plate is arranged on a horizontal plate of the fixing plate; and a second screw thread hole corresponding to the first screw thread hole is further arranged on the second straight plate; the fixing plate is sequentially inserted into the first screw thread hole and the second screw thread hole by means of a screw bolt to fix the fixing plate on the supporting frame.

Further, a recessed portion fit with the rotation shaft is arranged on the longitudinal plate of the fixing plate.

Further, both the quantity of the first screw thread holes and the second screw thread holes is two, and the two first screw thread holes respectively correspond to the two second screw thread holes; the fixing plate is sequentially inserted into the first screw thread holes and the second screw thread holes by means of two screw bolts to fix the fixing plate on the supporting frame.

Further, the recessed portion of the longitudinal plate of the fixing plate abuts against the rotation shaft, and the upper mounting plate flips around the rotation shaft.

Further, the outdoor unit electric cabinet further comprises two supporting frames arranged on upper portions of inner walls on two sides of the box body; a third screw thread hole corresponding to the second screw thread hole is arranged on two ends of the upper portion of the upper mounting plate; the upper mounting plate is sequentially inserted into the third screw thread hole and the second screw thread hole by means of a screw bolt to fix the upper mounting plate on the supporting frames on upper portions of inner walls on two sides of the box body.

This disclosure further provides an air conditioner comprising the above outdoor unit electric cabinet.

An outdoor unit electric cabinet provided by this disclosure is arranged with a box body, multiple supporting frames, an upper mounting plate, and a fixing plate. The multiple supporting frames are respectively arranged on inner peripheral walls of the box body; the upper mounting plate is mounted on a mounting location of the supporting frames; the fixing plate is arranged at a joint of the upper mounting plate and the supporting frames to prevent the upper mounting plate from sliding out from the mounting location. Hence, for the upper mounting plate, the upper mounting plate is mounted on the box body by means of the conjunction function of the supporting frame and the fixing plate. Meanwhile, the upper mounting plate may rotate relative to the mounting location; therefor, by rotating the upper mounting plate, relative movement occurs between the upper mounting plate and the box body, so as to expose electric elements shielded by the upper mounting plate, and facilitate the maintenance and replacement of electric elements inside the electric cabinet, and it has a simple structure and convenient operation.

Figure 1:
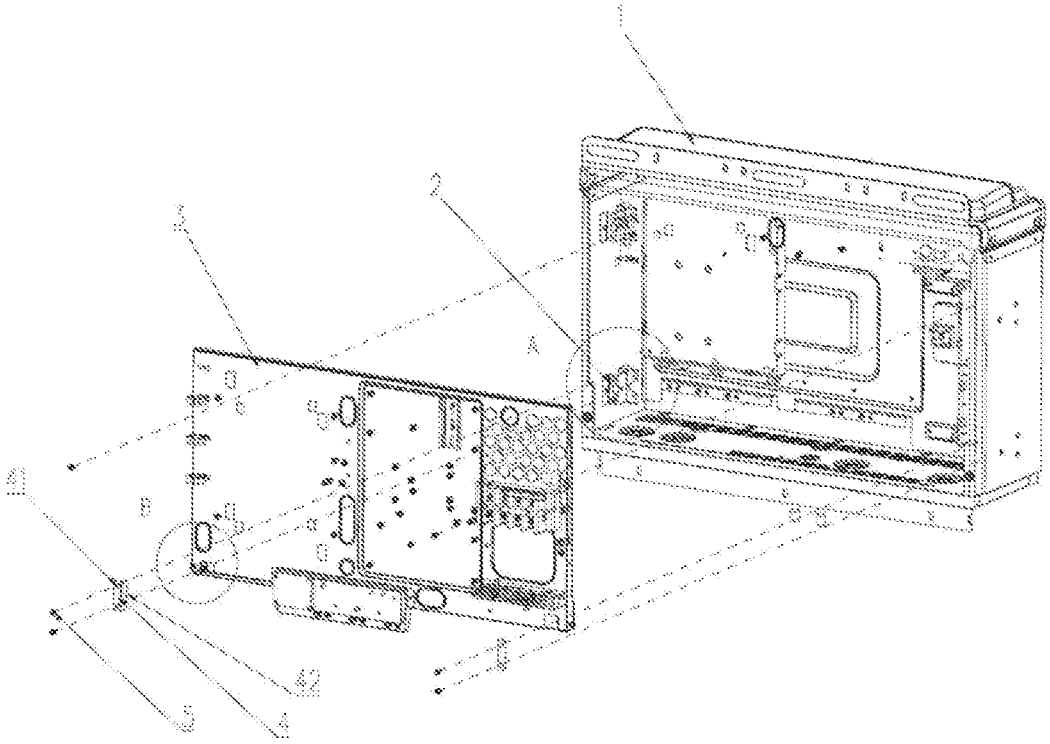
FIG. 1 is an exploded view of an outdoor unit electric cabinet according to an embodiment of this disclosure.
Figure 2:
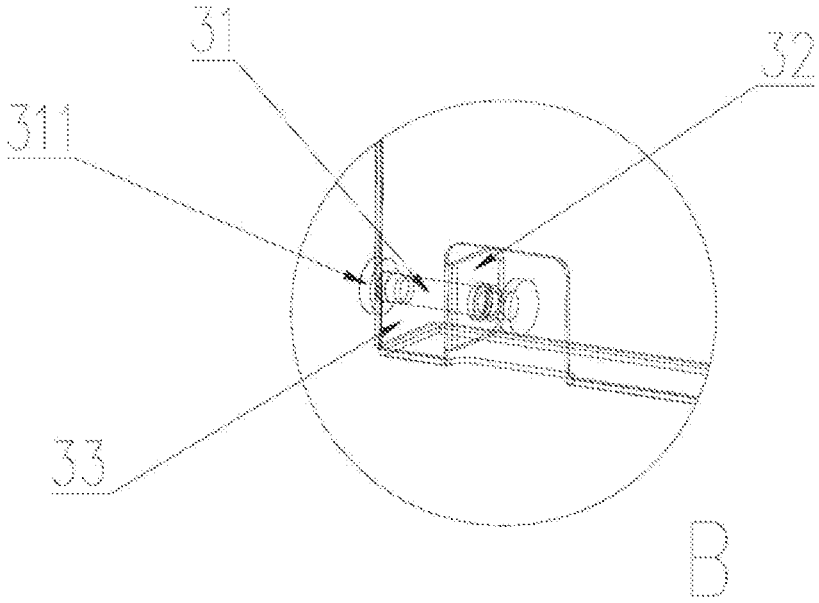
FIG. 2 is a schematic diagram of area B in FIG. 1.
Figure 3:
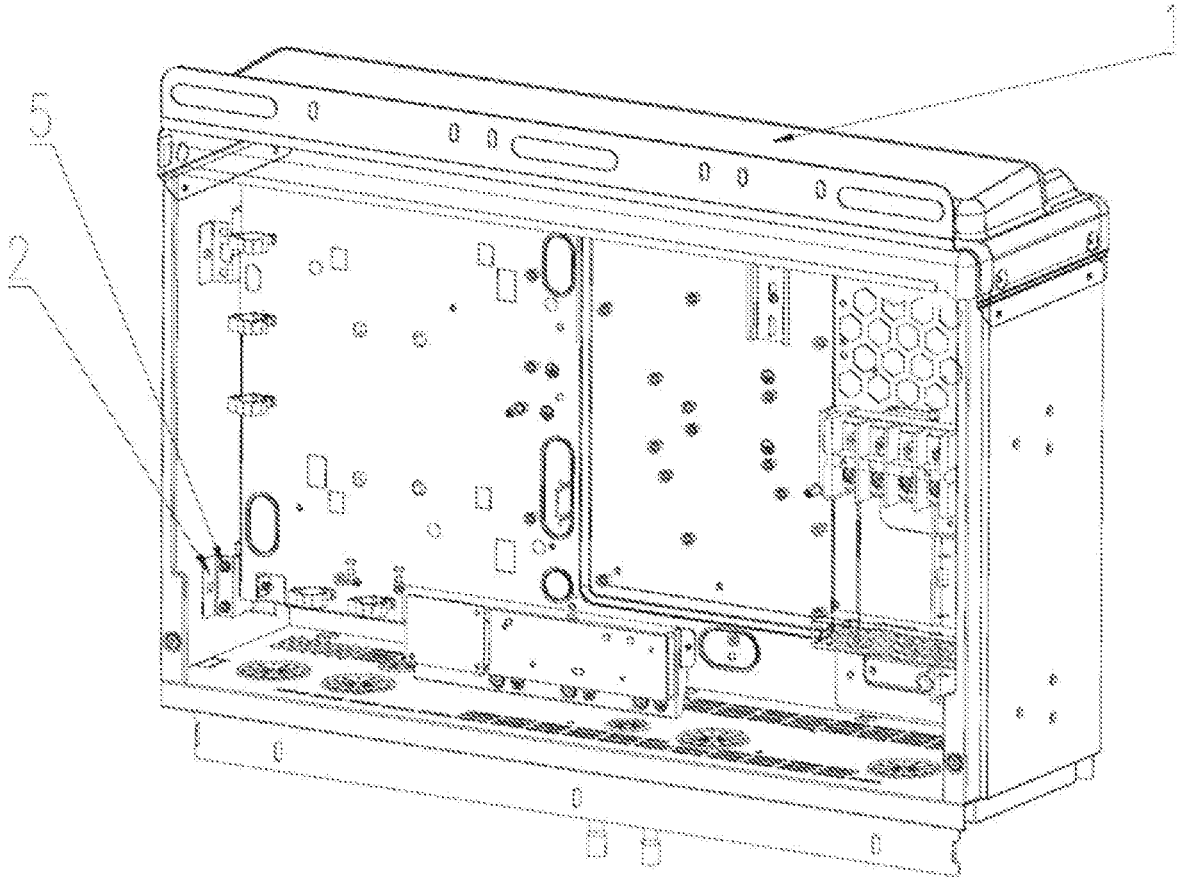
FIG. 3 is a schematic diagram of an outdoor unit electric cabinet not mounted with an upper mounting plate according to an embodiment of this disclosure.

In the drawings, box body 1, supporting frame 2, first flanging 21, main body portion 22, mounting location 221, second screw thread hole 222, upper mounting plate 3, rotation shaft 31, fixing portion 311, connecting plate 32, second flanging 33, fixing plate 4, first screw thread hole 41, recessed portion 42, and screw bolt 5 are shown.

The realization of the purpose, functional characteristics and advantages of this disclosure will be further described in conjunction with the embodiments and with reference to the accompanying drawings.

DETAILED DESCRIPTION

It should be understood that the specific embodiments described here are only used to explain this disclosure, and are not used to limit this disclosure.

As shown in FIG. 1, this disclosure provides an outdoor unit electric cabinet, comprising box body 1, two supporting frames 2, upper mounting plate 3, and fixing plate 4. Two supporting frame 2 are arranged on inner walls on the opposite sides of box body 1; mounting location 221 is arranged on each supporting frame 2; the opposite sides of upper mounting plate 3 are mounted into mounting location 221 into mounting location 221 from an entrance of mounting location 221; upper mounting plate 3 is flippable relative to mounting location 221; fixing plate 4 is mounted on the entrance of mounting location 221 to seal the entrance of mounting location 221, so as to prevent upper mounting plate 3 from sliding out from mounting location 221.

Two supporting frame 2 are respectively arranged on the bottom of inner walls on two sides of box body 1; upper mounting plate 3 is mounted into mounting location 221 of supporting frame 2 from the entrance of mounting location 221, and fixing plate 4 is mounted on the entrance of mounting location 221 to seal the entrance of mounting location 221 and prevent upper mounting plate 3 from sliding out from mounting location 221. Hence, for upper mounting plate 3, upper mounting plate 3 can be mounted on box body 1 by means of supporting frames 2 on the bottom of two sides of box body 1. Meanwhile, upper mounting plate 3 is flippable relative to mounting location 221; therefore, by means of rotating upper mounting plate 3, relative movement occurs between upper mounting plate 3 and box body 1 so as to expose electric elements shielded by upper mounting plate 3 and facilitate maintenance and replacement of electric elements inside the electric cabinet; and it has a simple structure and convenient operation.

Figure 4:
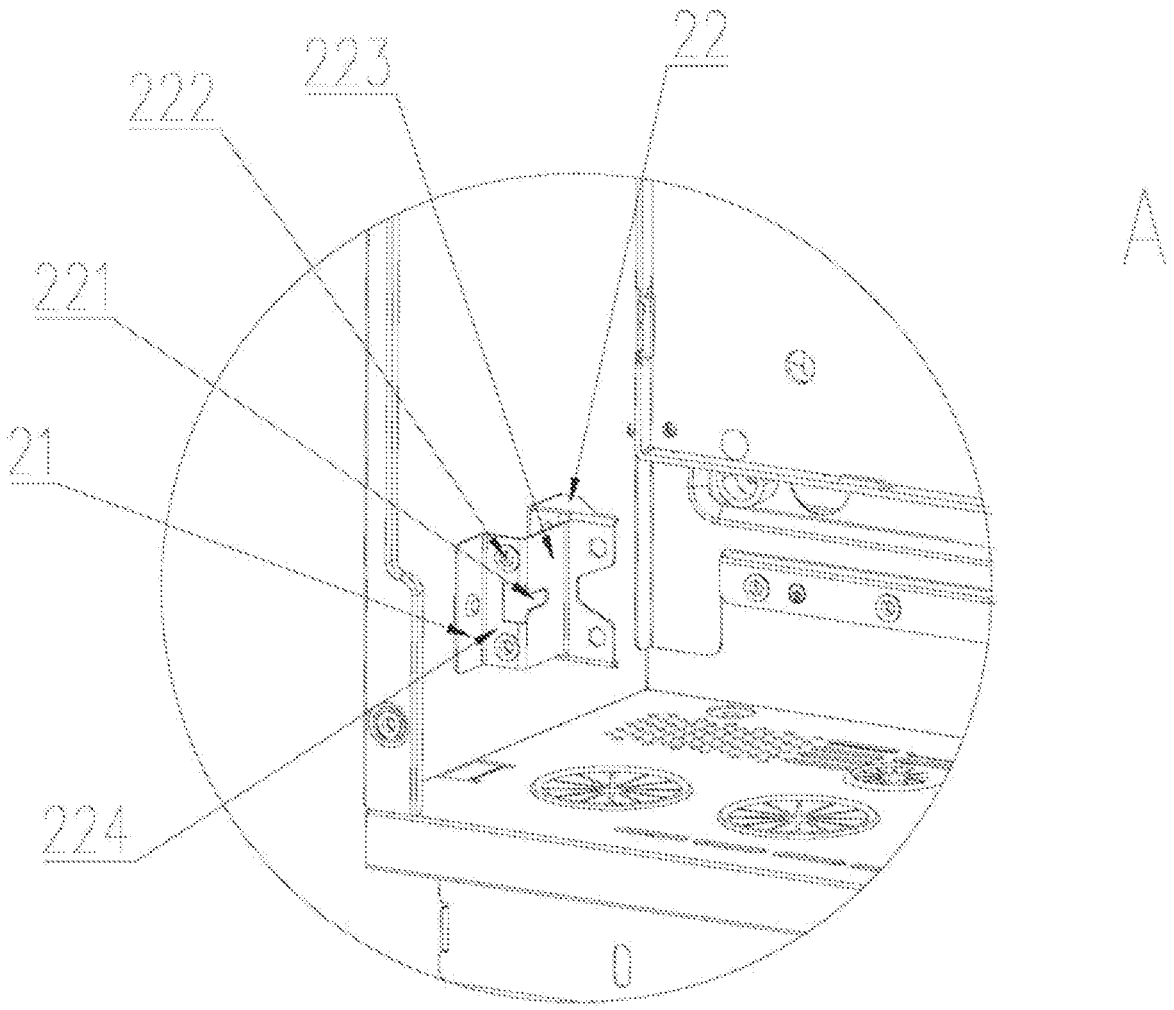
FIG. 4 is a schematic diagram of area A in FIG. 3.
Figure 5:
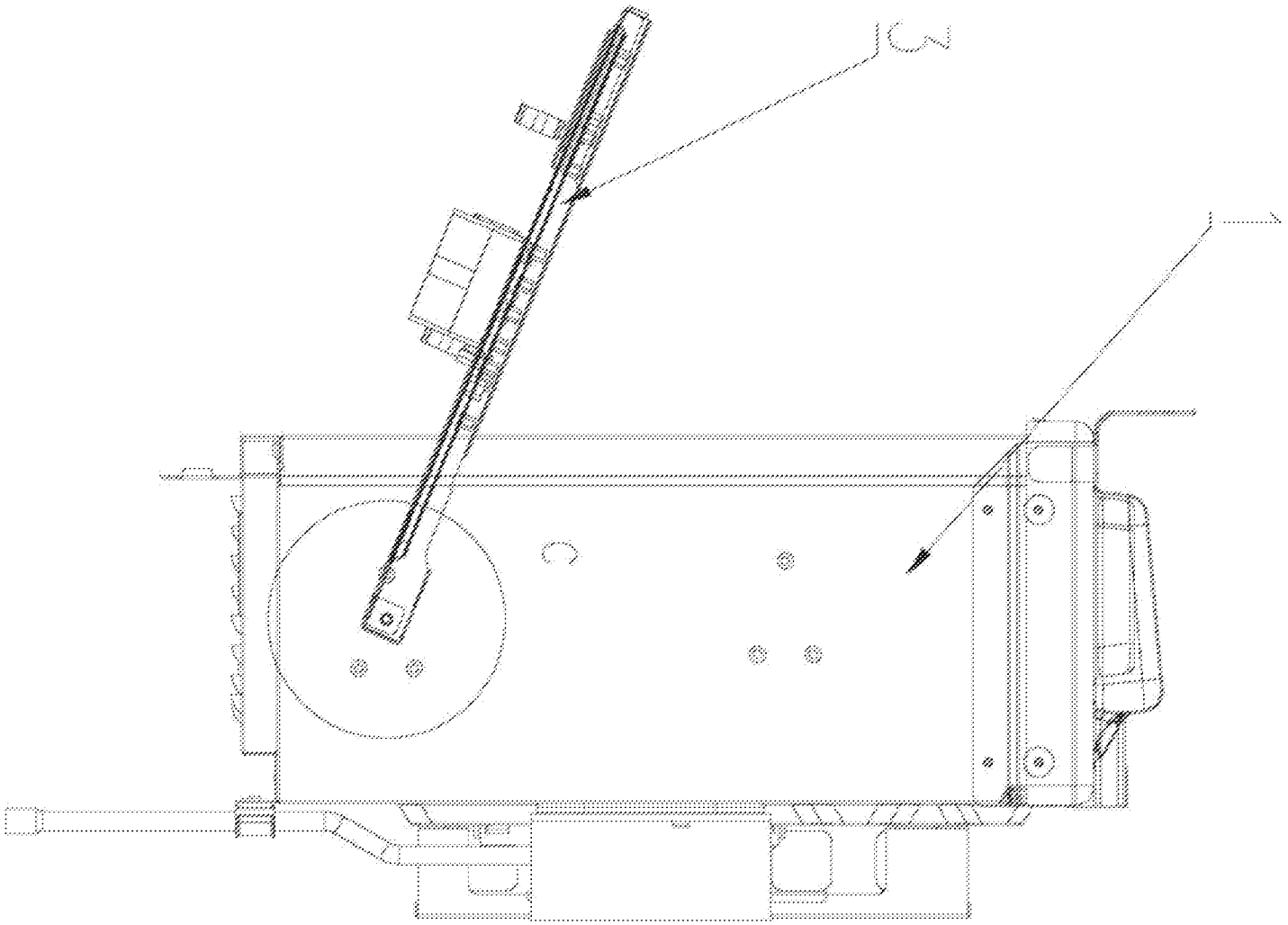
FIG. 5 is a right view of an upper mounting plate after rotation according to an embodiment of this disclosure.
Figure 6:
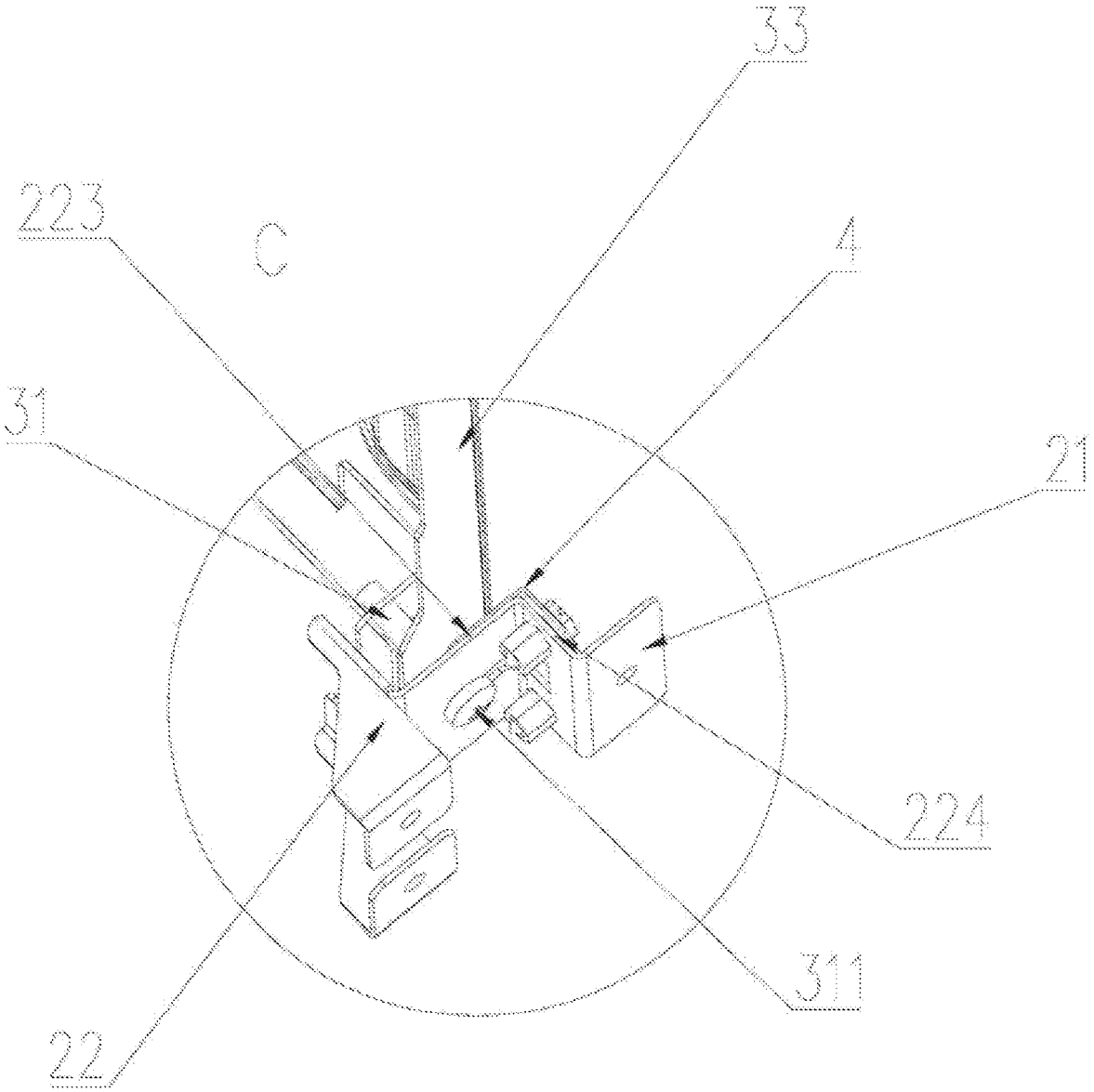
FIG. 6 is a three-dimensional schematic diagram of area C in FIG. 5.

In an embodiment, as shown in FIG. 4, supporting frame 2 comprises main body portion 22 and first flanging 21. Main body portion 22 comprises first straight plate 223 and second straight plate 224; first straight plate 223 and second straight plate 224 are fixedly connected to form an angle; second straight plate 224 is bent away from one side of first straight plate 223 to form first flanging 21; main body portion 22 is connected to box body 1 by means of first flanging 21; and an entrance of mounting location 221 is arranged on second straight plate 224.

Hence, it can prevent upper mounting plate 3 from rubbing and colliding with an inner wall of box body 1 and damage the inner wall of box body 1 when rotating or moving. Second straight plate 224 of main body portion 22 is bent to form first flanging 21, and first flanging 21 is connected to box body 1, thus facilitating assembly and fixation of supporting frame 2 and box body 1. As shown in FIG. 4, first flanging 21 may be provided with assembly holes, and for supporting frame 2, supporting frame 2 may be fixedly assembled to the inner peripheral wall of box body 1 through the assembly holes with threaded connectors.

In an embodiment, supporting frames 2 are arranged on the bottom of inner walls on two sides of box body 1; two sides of upper mounting plates 3 are bent to form second flanging 33; connecting plate 32 is arranged on two ends of the bottom of upper mounting plate 3; connecting plate 32 and second flanging 33 are arranged in a same direction; rotation shaft 31 runs through connecting plate 32 and second flanging 33; fixing positions 311 are arranged on two ends of rotation shaft 31, and a portion between fixing portion 311 close to second flanging 33 on rotation shaft 31 and second flanging 33 is mounted on mounting location 221.

Two supporting frames 2 are arranged on the bottom of inner walls on two sides of box body 1; upper mounting plates 3 are mounted on supporting frame 2 from two ends of the bottom, so as to facilitate that upper mounting plate 3 rotates by taking the bottom side as a shaft. Two sides of upper mounting plate 3 are bent to form second flanging 33; second flanging 33 and connecting plate 32 are arranged in a same direction, and rotation shaft 31 penetrates therethrough, so as to make upper mounting plate 3 be capable of flipping when the bottom side is mounted to supporting frame 2. Fixing portions 311 are arranged on two ends of rotation shaft 31. Generally, the area of the cross section connecting fixing portion 311 and rotation shaft 31 is larger than the area of the cross section of rotation shaft 31 so that when rotation shaft 31 penetrates between second flanging 33 and connecting plate 32, it will not fall off connecting plate 32 and second flanging 33. When rotation shaft 31 penetrates between second flanging 33 and connecting plate 32, the length of rotation shaft 31 is larger than the distance between second flanging 33 and connecting plate 32, so that a gap may be formed between fixing portion 311 close to second flanging 33 and second flanging 33, and a portion between fixing portion 311 close to second flanging 33 on rotation shaft 31 and second flanging 33 can be mounted on mounting location 221. The mounting manners of two ends on the bottom of upper mounting plate 3 are totally the same, so as to make upper mounting plate 3 be mounted on supporting frame 2.

In an embodiment, mounting location 221 is a U-shaped groove. An entrance of mounting location 221 is communicated with the U-shaped groove. The longest straight line of a contact surface between fixing portion 311 close to second flanging 33 and first straight plate 223 of main body portion 22 is greater than the width of the U-shaped groove.

Mounting location 221 is set as a U-shaped groove, so that the end of mounting location 221 can be closer to the curvature of the outer circumference of rotation shaft 31, not damaging rotation shaft 31 during mounting and fixing. The longest straight line of a contact surface between fixing portion 311 close to second flanging 33 on rotation shaft 31 and first straight plate 223 of main body portion 22 is greater than the width of the U-shaped groove, so that fixing portion 311 will not penetrate through the U-shaped groove, rotation shaft 31 can be mounted on the U-shaped groove and will not fall off.

In an embodiment, fixing plate 4 is L-shaped; a longitudinal plate of fixing plate 4 is inserted into a gap between first straight plate 223 of main body portion 22 and second flanging 33; first screw thread hole 41 used to fix fixing plate 4 is arranged on a horizontal plate of fixing plate 4; second screw thread hole 222 corresponding to first screw thread hole 41 is further arranged on second straight plate 224 of main body portion 22; fixing plate 4 is sequentially inserted into first screw thread hole 41 and second screw thread hole 222 by means of screw bolt 5 to fix fixing plate 4 on supporting frame 2.

Fixing plate 4 is set as L-shaped so that fixing plate 4 can fix upper mounting plate 3 on supporting frame 2 when being inserted into the gap. First screw thread hole 41 used to fix fixing plate 4 is arranged on a horizontal plate of fixing plate 4; second screw thread hole 222 corresponding to first screw thread hole 41 is arranged on second straight plate 224 of main body portion 22; by means of merely rotating screw bolt 5, only first screw thread hole 41 and second screw thread hole 222 may lock fixing plate 4 on supporting frame 2. Meanwhile, since fixing plate 4 is L-shaped, the longitudinal plate thereof is inserted into the gap between second straight plate 224 of main body portion 22 and second flanging 33, and can abut against rotation shaft 31 and prevent it from sliding out. Therefore, by means of fixing plate 4 and screw bolt 5, mounting of upper mounting plate 3 and supporting frame 2 and mounting of fixing plate 4 and supporting frame 2 can be realized.

In an embodiment, recessed portion 42 fit with rotation shaft 31 is arranged on the longitudinal plate of fixing plate 4.

Recessed portion 42 is arranged, and can fit with the curvature of the outer circumferential surface of rotation shaft 31 when the longitudinal plate of fixing plate 4 is inserted into the gap between second straight plate 224 of main body portion 22 and second flanging 33 to abut against rotation shaft 31, so that rotation shaft 31 is not damaged when the longitudinal plate of fixing plate 4 abuts against rotation shaft 31.

In an embodiment, both the quantity of first screw thread hole 41 and second screw thread hole 222 is two, and two first screw thread holes 41 respectively correspond to two second screw thread holes 222. Fixing plate 4 is sequentially inserted into first screw thread hole 41 and second screw thread hole 222 by means of two screw bolts 5 to fix fixing plate 4 on supporting frame 2.

Two screw thread holes are arranged on second straight plate 224 of main body portions of fixing plate 4 and supporting frame 2. Two screw bolts 5 are sequentially inserted into first screw thread hole 41 and second screw thread hole 222 to fix supporting frame 2 and the mounting plate, which is more stable than using single screw bolt 5.

In an embodiment, the recessed portion of the longitudinal plate of fixing plate 4 abuts against rotation shaft 31, and upper mounting plate 3 rotates around rotation shaft 31.

The longitudinal plate of fixing plate abuts against rotation shaft 31 by means of recessed portion 42, and can clamp rotation shaft 31 between the bottom edge of the longitudinal plate of fixing plate 4 and the bottom of the U-shaped groove. In the prior art, the mounting structure of electronically controlled sheet metal components is not compact, which easily causes the components to collide with each other and generate noise. If the length of the longitudinal plate of fixing plate 4 is long enough to abut against rotation shaft 31, so that the edge of the longitudinal plate of fixing plate 4 and the bottom of the U-shaped groove cannot form a large gap, thereby avoiding the collision of rotation shaft 31 moving back and forth in this gap to damage rotation shaft 31, and also avoiding the noise caused by the collision of sheet metal during the transportation of the machine, which is simple for production and maintenance operations and improves efficiency.

In an embodiment, two supporting frames 2 arranged on the upper portion of inner walls on two sides of box body 1 are included. Third screw thread hole corresponding to second screw thread hole 222 is arranged on two ends of the upper portion of upper mounting plate 3. Upper mounting plate 3 is sequentially inserted into third screw thread hole and second screw thread hole 222 by means of screw bolt 5 to fix upper mounting plate 3 on supporting frames 2 on upper portions of inner walls on two sides of the box body.

Two supporting frames 2 are arranged on the upper portion of inner walls on two sides of box body 1. Second screw thread hole 222 is arranged on supporting frame 2. Upper mounting plate 3 is rotated to a corresponding position after the maintenance is completed. Third screw thread holes on two ends of the upper portion of upper mounting plate 3 are aligned with second screw thread hole 222 on supporting frame 2. By rotating screw bolt 5 into second screw thread hole 222 and third screw thread hole, the upper portion of upper mounting plate 3 can be mounted on box body 1. When mounting, debugging and maintaining, screw bolts 5 on two ends of the upper portions of upper mounting plate 3 are disassembled, and upper mounting plate 3 is flipped down to facilitate debugging and maintenance of components. After mounting, debugging, and maintenance are completed, upper mounting plate 3 is rotated to the initial position, and is fixed by means of the third screw thread hole on the upper portion of upper mounting plate 3. The operation is simple.

This disclosure further provides an air conditioner including the above outdoor unit electric cabinet.

In an outdoor unit electric cabinet of an air conditioner and an air conditioner with the outdoor unit electric cabinet provided by this disclosure, when being mounted, debugged, and maintained, electronically controlled upper mounting plate 3 does not need to be disassembled. By means of rotation shaft 31, opening, closing, and mounting of upper mounting plate 3 of the electric cabinet is convenient and fast. When being mounted, debugging, and maintaining, upper mounting plate 3 rotates around rotation shaft 31 and flips up and down. After mounting, debugging and maintenance are completed, it is fixed through the screw thread holes on the upper portions of upper mounting plate 3 to ensure that four corners of upper mounting plate 3 are fixed. Fixing plate 4 clamps rotation shaft 31 to avoid the noise caused by the collision of sheet metal during the transportation and operation of the machine, and the production and maintenance operations are simple, and the efficiency is improved.

It should be noted that in this article, the terms "comprise", "include" or any other variants thereof are intended to cover non-exclusive inclusion, thus a process, a device, an article or a method that includes a series of elements includes not only those elements, but also other elements that are not explicitly listed, or also includes elements inherent to such a process, device, article, or method. If there are no more restrictions, the element defined by the sentence "comprising a . . . " does not exclude the existence of other identical elements in the process, device, article, or method that includes the element.

The above descriptions are only preferred embodiments of this disclosure, and do not therefore limit the patent scope of this disclosure. Any equivalent structure or equivalent process transformation made by using the content of the description and drawings of this disclosure, or directly or indirectly used in other related technical fields, are similarly included in the scope of patent protection of this disclosure.

What is claimed is:

1. An outdoor unit electric cabinet, comprising a box body, two supporting frames, an upper mounting plate, and a fixing plate separate from the two supporting frames, wherein the two supporting frames are arranged on inner walls on the opposite sides of the box body; a mounting location is arranged on each supporting frame; the opposite sides of the upper mounting plate are mounted into the mounting location from an entrance of the mounting location; the upper mounting plate is flippable relative to the mounting location; the fixing plate is mounted to a supporting frame on the entrance of the mounting location to seal the entrance of the mounting location of the supporting frame, so as to prevent the upper mounting plate from sliding out from the mounting location;

wherein the supporting frame comprises a main body portion and a first flanging, the main body portion comprises a first straight plate and a second straight plate; the first straight plate and the second straight plate are fixedly connected to form an angle; the second straight plate is bent away from one side of the first straight plate to form the first flanging; the main body portion is connected to the box body by means of the first flanging; and the entrance of the mounting location is arranged on the second straight plate;

wherein the supporting frames are arranged on the bottom of inner walls on two sides of the box body;

two sides of the upper mounting plate are bent to form the second flanging; a connecting plate is arranged on two ends of the bottom of the upper mounting plate; the connecting plate and the second flanging are arranged in a same direction; and a rotation shaft runs through the connecting plate and the second flanging; and fixing positions are arranged on two ends of the rotation shaft, and a portion between a fixing portion close to the second flanging on the rotation shaft and the second flanging is mounted on the mounting location.

2. The outdoor unit electric cabinet according to claim 1, wherein the mounting location is a U-shaped groove; the entrance of the mounting location is communicated with the U-shaped groove; and the longest straight line of a contact surface between the fixing portion close to the second flanging and the first straight plate is greater than the width of the U-shaped groove.

3. The outdoor unit electric cabinet according to claim 1, wherein the fixing plate is L-shaped; a longitudinal plate of the fixing plate is inserted into a gap between the first straight plate and the second flanging; and a first screw thread hole used to fix the fixing plate is arranged on a horizontal plate of the fixing plate; and a second screw thread hole corresponding to the first screw thread hole is further arranged on the second straight plate; the fixing plate is sequentially inserted into the first screw thread hole and the second screw thread hole by means of a screw bolt to fix the fixing plate on the supporting frame.

4. The outdoor unit electric cabinet according to claim 3, wherein a recessed portion fit with the rotation shaft is arranged on the longitudinal plate of the fixing plate.

5. The outdoor unit electric cabinet according to claim 3, wherein both the quantity of the first screw thread holes and the second screw thread holes is two, and the two first screw thread holes respectively correspond to the two second screw thread holes; the fixing plate is sequentially inserted into the first screw thread holes and the second screw thread holes by means of two screw bolts to fix the fixing plate on the supporting frame.

6. The outdoor unit electric cabinet according to claim 3, wherein the recessed portion of the longitudinal plate of the fixing plate abuts against the rotation shaft, and the upper mounting plate flips around the rotation shaft.

7. The outdoor unit electric cabinet according to claim 3, further comprising two supporting frames arranged on upper portions of inner walls on two sides of the box body; a third screw thread hole corresponding to the second screw thread hole is arranged on two ends of the upper portion of the upper mounting plate; the upper mounting plate is sequentially inserted into the third screw thread hole and the second screw thread hole by means of a screw bolt to fix the upper mounting plate on the supporting frames on upper portions of inner walls on two sides of the box body.

8. An air conditioner, comprising an outdoor unit electric cabinet according to claim 1.

* * * * *